US005908064A

United States Patent [19]

Bruce

[11] Patent Number: 5,908,064

[45] **Date of Patent: *Jun. 1, 1999**

[54] BATHING DOOR UNIT

[75] Inventor: Larry D. Bruce, Mayfield, Ky.

[73] Assignee: Sterling Plumbing Group, Inc., Rolling Meadows, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,646

[22] Filed: Oct. 30, 1996

[51] Int. Cl.[6] ..... E05D 15/26

[52] U.S. Cl. ..... 160/202; 160/211; 160/213

[58] Field of Search ..... 160/211, 213, 160/202, 354, 206, 199, 210, 197, 117, 119, 118; 4/557, 607, 610

[56] References Cited

U.S. PATENT DOCUMENTS

| | | | |
|---|---|---|---|
| 2,331,822 | 10/1943 | Zechiel et al. | 160/206 |
| 2,723,896 | 11/1955 | Wurtz | 312/296 |
| 2,833,346 | 5/1958 | Preston | 160/197 |
| 2,850,089 | 9/1958 | Burke | 160/202 |
| 2,852,816 | 9/1958 | Spretnjak et al. | 20/52 |
| 3,054,118 | 9/1962 | Bullock | 4/149 |
| 3,102,581 | 9/1963 | Kochanowski | 160/196 |
| 3,111,208 | 11/1963 | Grossman | 189/46 |
| 3,188,699 | 6/1965 | Walters | 20/19 |
| 3,272,257 | 9/1966 | Dirubbo | 160/354 |
| 3,750,737 | 8/1973 | Woodward | 160/206 |
| 4,276,919 | 7/1981 | Walters | 160/206 |
| 4,358,863 | 11/1982 | Jacobsen | 4/607 |
| 4,437,266 | 3/1984 | Keller | 49/493 |
| 4,512,045 | 4/1985 | Baus | 4/610 |
| 4,606,081 | 8/1986 | Baus | 4/557 |
| 4,619,074 | 10/1986 | Leung et al. | 49/143 |
| 4,635,699 | 1/1987 | Kauffman et al. | 160/211 |
| 4,785,485 | 11/1988 | Etesam | 4/557 |
| 4,878,530 | 11/1989 | Jean | 160/211 |
| 4,897,889 | 2/1990 | Baus | 4/607 |
| 4,914,770 | 4/1990 | Baus | 4/612 |
| 4,981,164 | 1/1991 | Reichel | 160/187 |
| 5,097,543 | 3/1992 | Oille | 4/607 |
| 5,123,129 | 6/1992 | Lyons | 4/557 |
| 5,417,272 | 5/1995 | Marlowe et al. | 160/202 |

FOREIGN PATENT DOCUMENTS

| | | | |
|---|---|---|---|
| 0445559A1 | 9/1991 | European Pat. Off. | E05D 11/10 |
| 0 541 877 | 5/1993 | European Pat. Off. . | |
| 1926341 | 11/1970 | Germany . | |
| 3838590 C1 | 11/1989 | Germany | A47K 3/22 |
| 3838591 A1 | 5/1990 | Germany | A47K 3/22 |
| 9205399 U | 7/1992 | Germany | A47K 3/22 |
| 4205784 | 10/1992 | Germany | A47K 3/22 |
| 296 18 205 | 2/1997 | Germany . | |

*Primary Examiner*—David M. Purol
*Attorney, Agent, or Firm*—Quarles & Brady LLP

[57] ABSTRACT

A pivotal and extendable bathing door unit is disclosed wherein a first panel is pivotally connected to a supporting wall, and a second panel is extendably connected to the first panel, so that the door can operate to enclose without an overhead track. There are roller brackets with tandem rollers connected to the first panel for riding in tracks in the second panel. The brackets afford ease of adjustment of the rollers and the tandem rollers afford a stable sliding and extension of the second panel. A minimum number of parts are required in a pivotal and extendable bathing door unit.

10 Claims, 8 Drawing Sheets

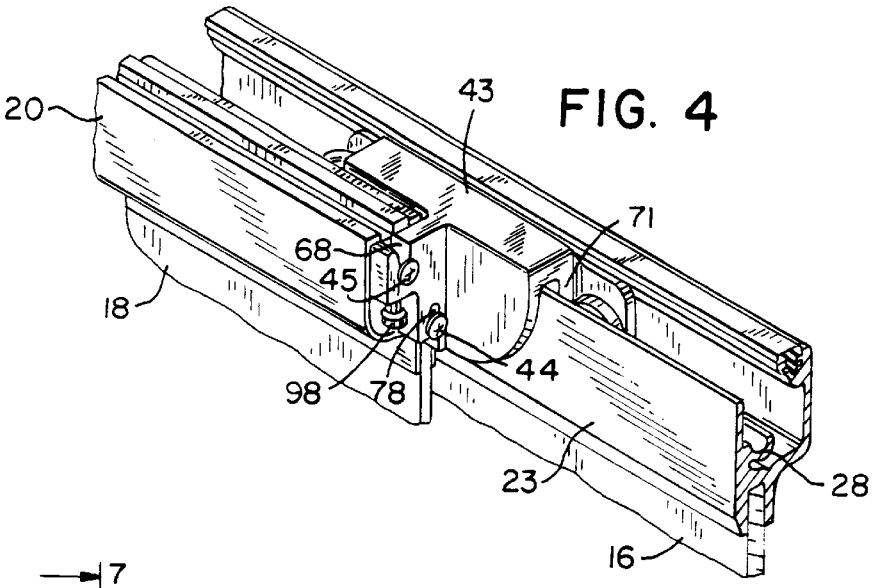
FIG. 4
FIG. 6
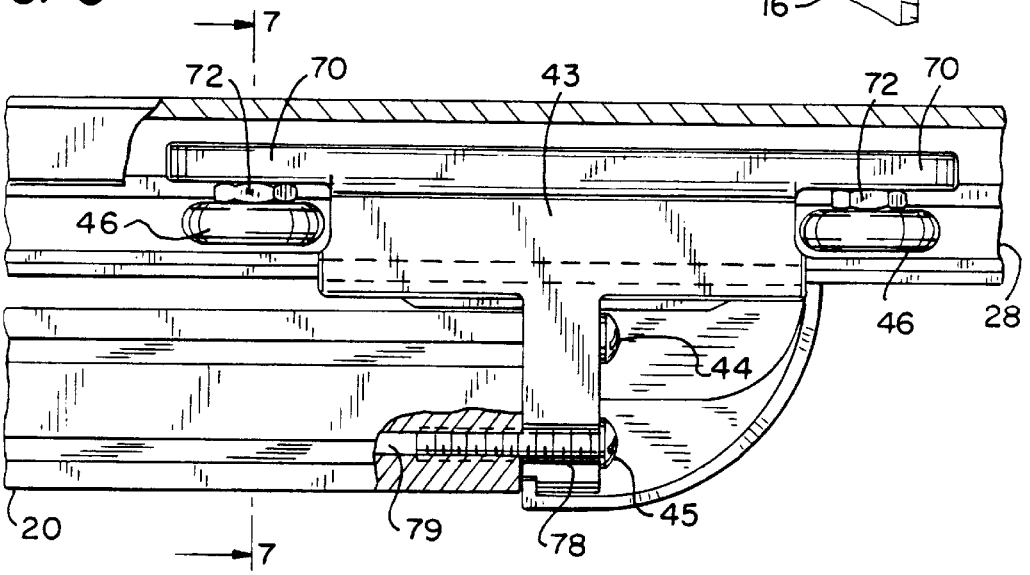
FIG. 22
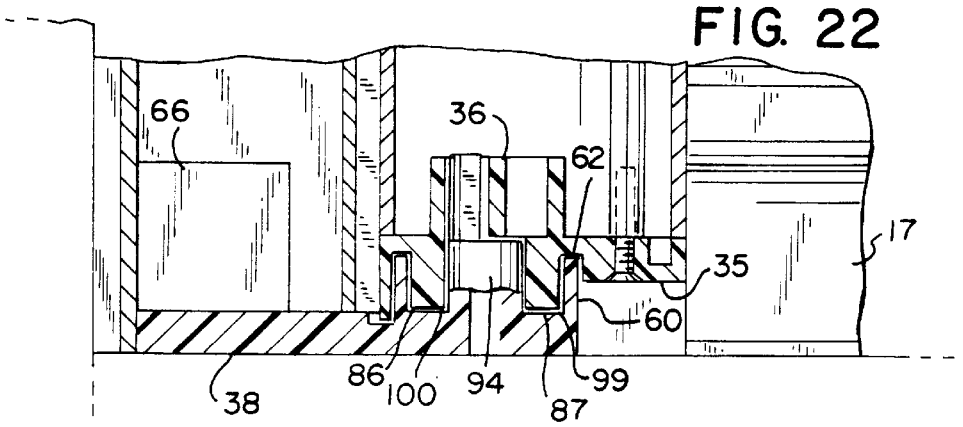

FIG. 8
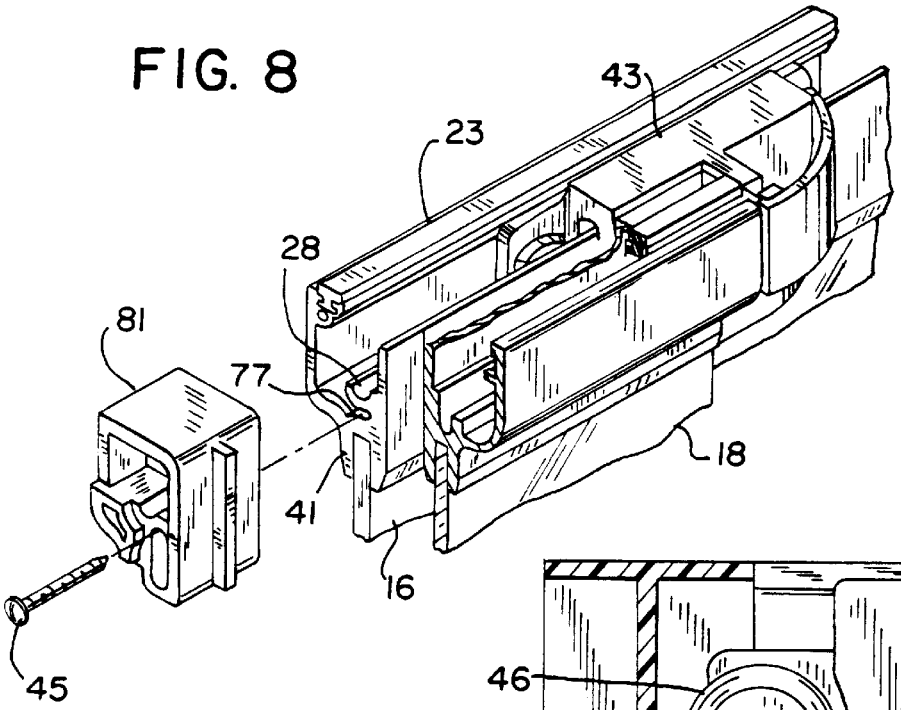
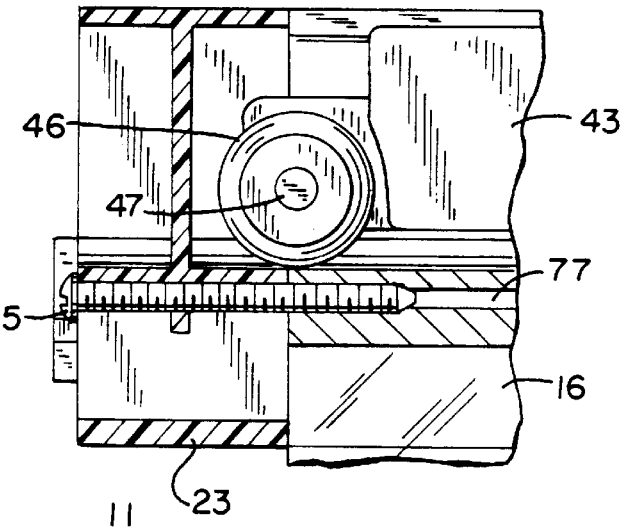
FIG. 10
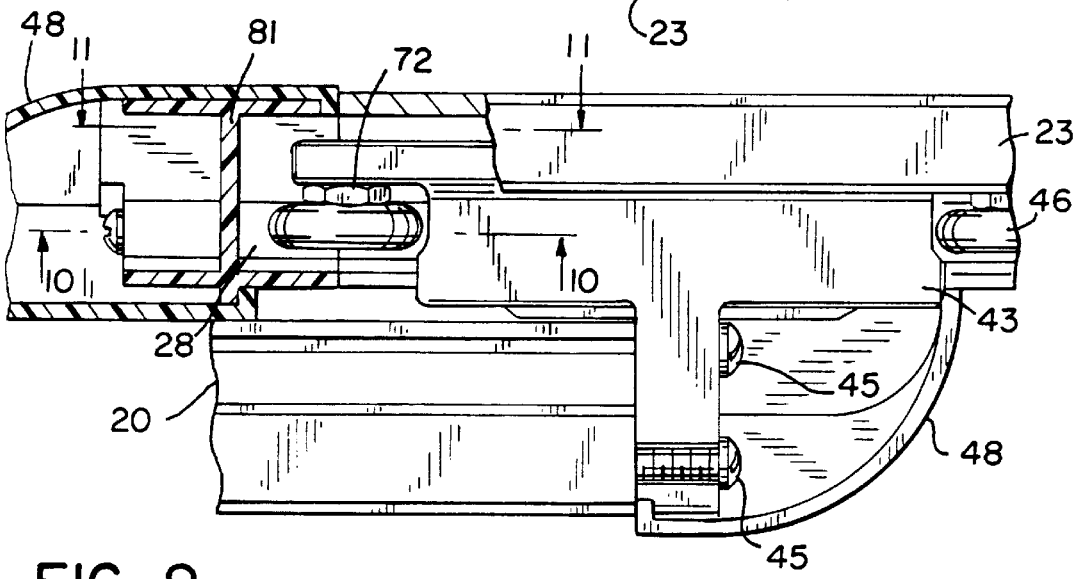
FIG. 9

FIG. 16
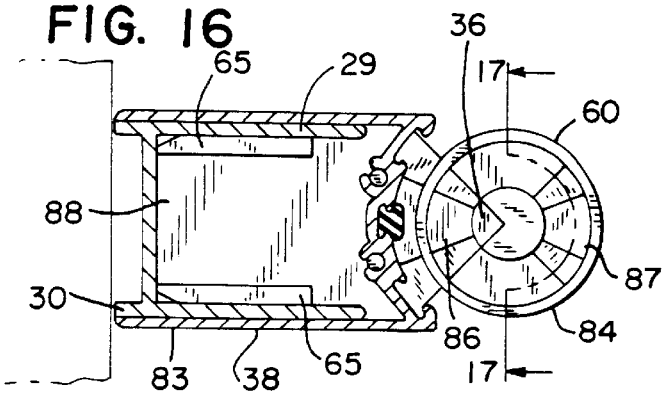
FIG. 17
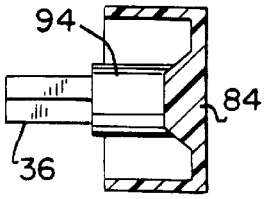
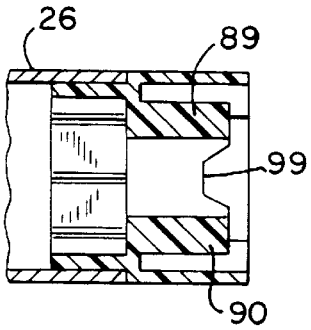
FIG. 18
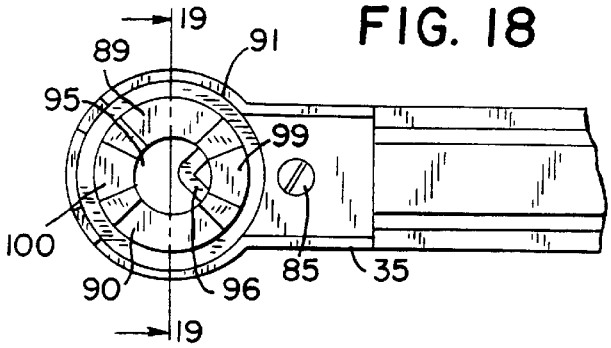
FIG. 19
FIG. 21
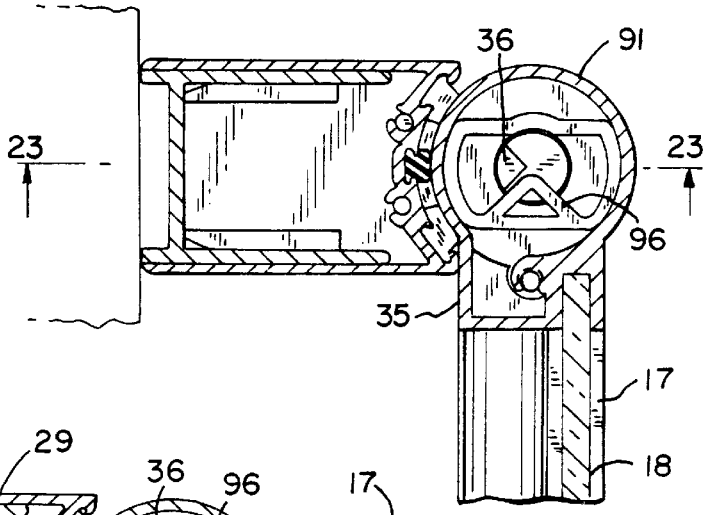
FIG. 20
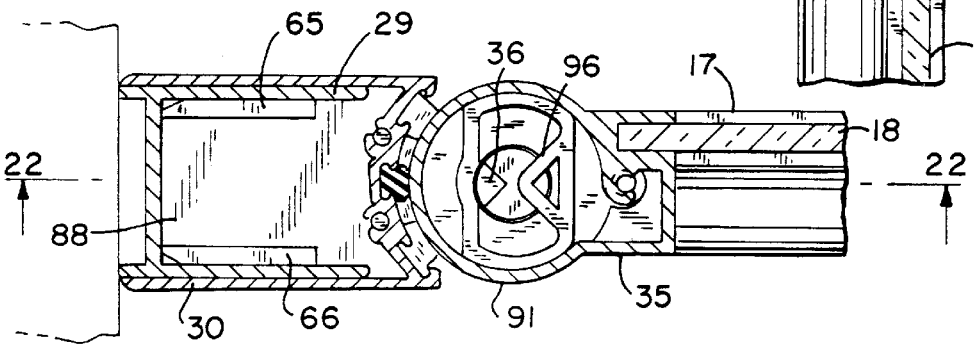

BATHING DOOR UNIT

CROSS REFERENCE TO RELATED APPLICATIONS

Not Applicable

FEDERALLY SPONSORED RESEARCH

Not Applicable

1. Field of the Invention

This invention relates to doors for bathing fixtures such as showers and bathtubs. More particularly it provides a door of adjustable size that requires no overhead support yet affords a simplified and stable extension of a slidable panel.

2. Background of the Invention

In the design of doors for showers and bathtubs, it is desirable to provide as wide open access as possible and still keep the cost of fabrication as low as possible. Such access facilitates cleaning of the bathing area, and makes rooms containing such areas appear more spacious.

In U.S. Pat. No. 5,417,272, there is disclosed in one embodiment a wall mounted bathroom panel assembly where a slidable panel operates in conjunction with a pivotal panel. This assembly provides the desired open access. However, the sliding action between the pivotal and sliding panel is effected by rollers and roller tracks mounted in both the pivotal and slidable panels for reciprocal engagement. This arrangement poses problems in that when the slidable panel is fully extended an undesired rocking can take place. This arrangement also makes the adjustment of the doors relative to one another difficult. Further, a multiple bracket and roller structure is required with brackets and rollers as well as roller tracks provided in both tracks connected to upper and lower portions of each panel.

U.S. Pat. 4,276,919 discloses rollers arranged in a tandem relationship for a shower door but not one having a pivotal and slidable door. Thus, a need exists for an improved bathing door unit.

BRIEF SUMMARY OF THE INVENTION

In one form, the invention provides a pivotal and extendable bathing door unit wherein a first panel is adapted to be pivotally connected to a supporting wall, the first panel having a roller bracket at the upper and lower ends thereof. A second panel is adapted to be extendably connected to said first panel, the second panel having a roller track at the upper and lower ends thereof. First and second rollers are connected to each said roller bracket with said rollers of the upper bracket of the first panel being suitable to ride in the upper track of the second panel and the rollers of the lower bracket of the first panel being suitable to ride in the lower track of the second panel.

In another embodiment, there are adjustment means operatively associated with the roller brackets for vertically positioning said rollers relative to said tracks.

In yet another embodiment, there are roller stop members connected to the second panel for contacting the roller brackets to thereby limit extension of the second panel.

In still another embodiment, the first and second panels are secured to discontinuous frame structures.

In yet another embodiment, there are camming means operatively associated with both the upper and lower ends of a support for the first panel to provide a lifting and stop action as well as guidance for the first panel upon rotation thereof.

It is, therefore, a principal object of the invention to provide a pivotal and an extendable bathing door unit of the above type which can provide a stable, slidable operation of the extendable door.

It is yet another object of the invention to provide a bathing door unit of the foregoing type which can be produced with few parts and at low cost.

It is still another object of the invention to provide an extendable bathing door unit of the foregoing type wherein the roller means for providing the extendibility of the panels can be easily adjusted.

It is another object of the invention to provide an extendable bathing door unit of the foregoing type which is adaptable to various sizes of bathing facilities.

It is still a further object of the invention to provide an extendable bathing door of the foregoing type which affords a lifting thereof to facilitate cleaning purposes.

It is yet a further object of the invention to provide an extendable bathing door of the foregoing type which can be employed as single or multiple units.

The foregoing and other objects and advantages of the invention will appear in the following detailed description. In the description, reference is made to the accompanying drawings which show, by way of illustration and not limitation, preferred embodiments of the invention.

BRIEF DESCRIPTION OF THE FIGURES

FIG. 4 is an enlarged detail view illustrating the slidable joint between the bathing door units;

FIG. 6 is a top view partially broken away, of the slidable joint shown in FIG. 4;

FIG. 8 is an enlarged detail view illustrating a stop feature for the rolling doors;

FIG. 9 is a view similar to FIG. 6 illustrating the stop feature of FIG. 8;

FIG. 10 is a sectional view taken along line 10—10 of FIG. 9;

FIG. 16 is a sectional view taken along line 16—16 of FIG. 13;

FIG. 17 is a sectional view taken along line 17—17 of FIG. 16;

FIG. 18 is a bottom view taken along line 18—18 of FIG. 13;

FIG. 19 is a sectional view taken along line 19—19 of FIG. 18;

FIG. 20 is a sectional view taken along line 20—20 of FIG. 12;

FIG. 21 is a view similar to FIG. 20 showing the pivoting of a panel;

FIG. 22 is a sectional view taken a long line 22—22 of FIG. 20;

DETAILED DESCRIPTION OF THE INVENTION

Figure 1:
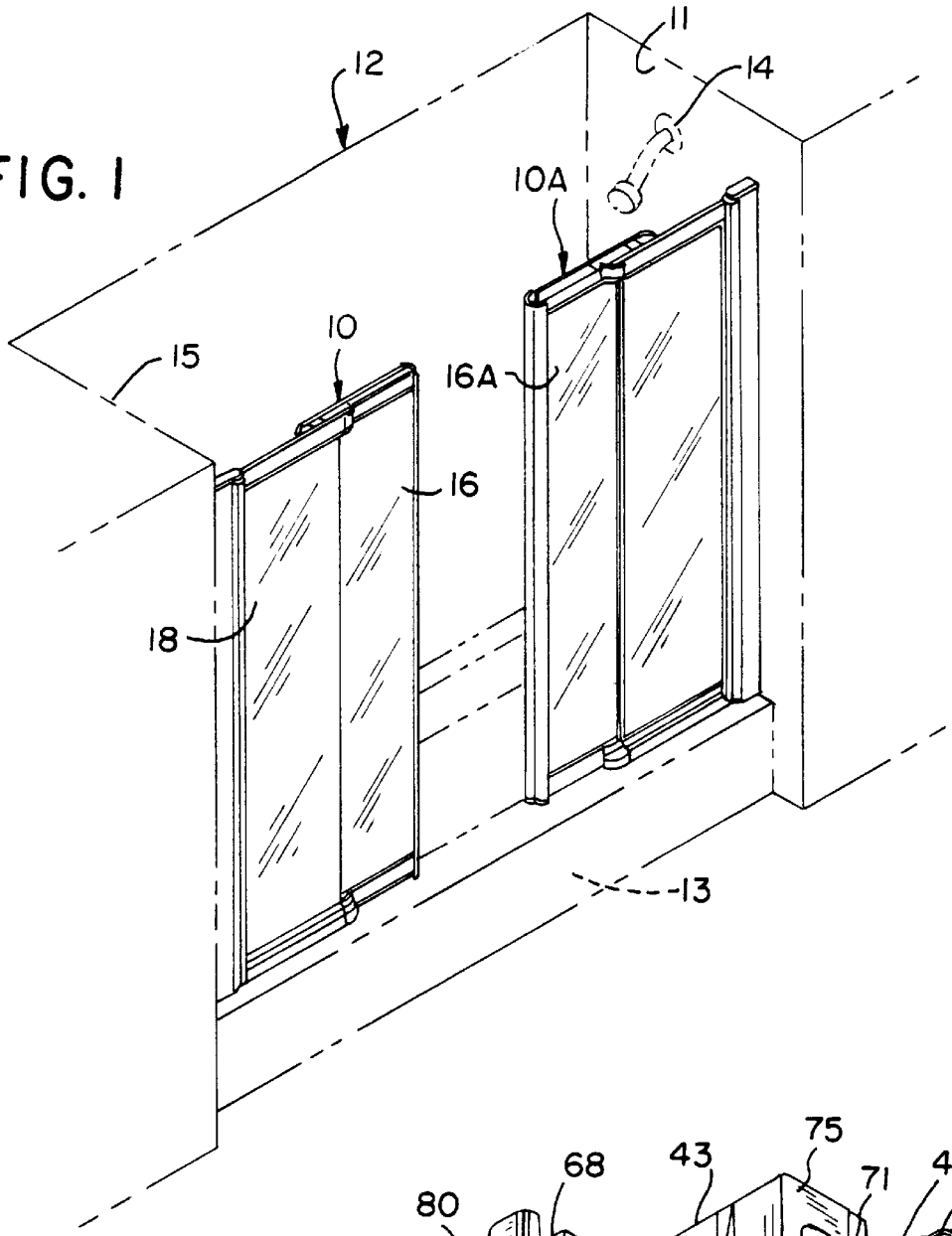
FIG. 1 is a top perspective view showing two of the bathing door units of this invention in conjunction with a bathing facility.
Figure 3:
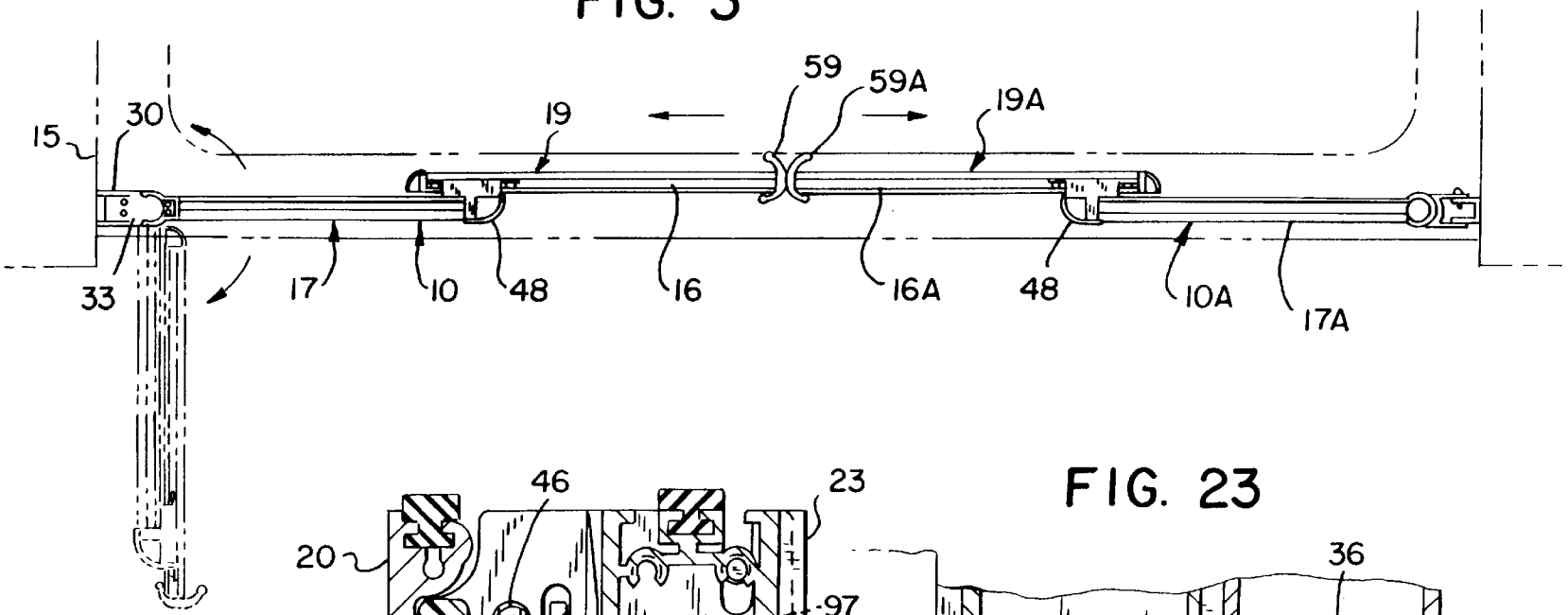
FIG. 3 is a top plan view illustrating the two folding bathing door units positioned as to fully extend the doors to a "closed" position.
Figure 23:
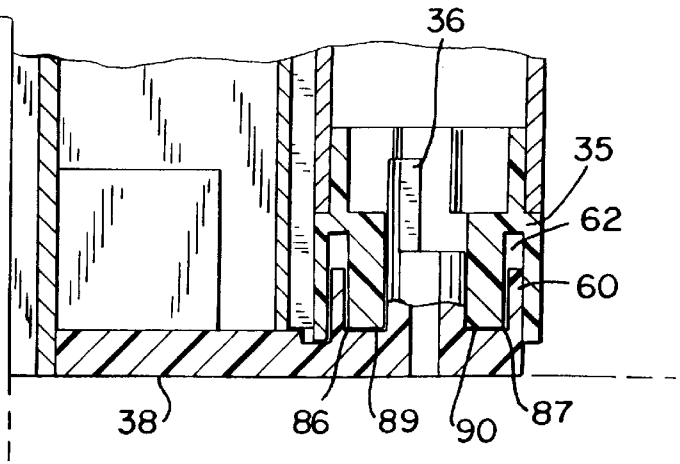
FIG. 23 is a sectional view taken along line 23—23 of FIG. 21.

Referring to FIGS. 1 and 3, the bathing door units of this invention are shown generally at 10 and 10A in conjunction with the bathing facility 12 having a tub 13, side walls 11 and 15 and a shower head 14. Each of the units 10 and 10A have the same components with those of unit 10A designed by the same reference numeral followed by the letter "A". The difference is in the orientation of the panels generally 17, 19 and 17A and 19A. This is seen in conjunction with FIG. 3 where the bathing units 10 and 10*a* are shown in an extended or closed position with respect to the bathing facility 12.

Figure 2:
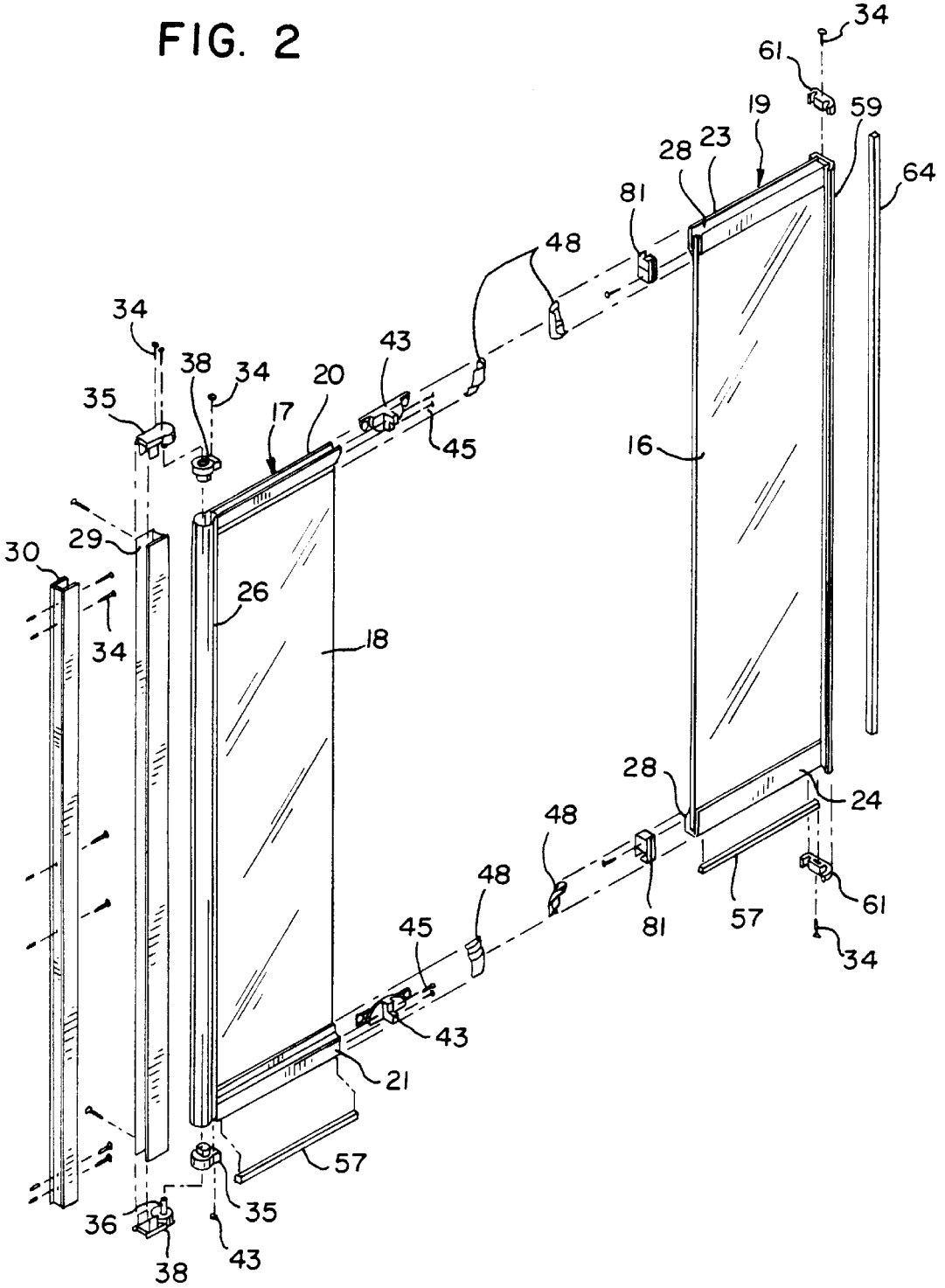
FIG. 2 is an exploded perspective view of one of the bathing door units shown in FIG. 1.

Referring specifically to FIG. 2, it is seen that each of the bathing door units as represented by unit generally 10, is composed of two panel members 16 and 18 with panel member 16 being a slidable panel and 18 being a pivotable panel member such as will be better understood as the description proceeds. Panel generally 17 includes panel member 18 as well as a top frame 20 and a bottom frame 21. In a similar manner, panel generally 19 also has similar top and bottom frames 23 and 24, respectively, secured to the top and bottom of panel member 16. Frames 23 and 24 have roller tracks such as 28, whereas frames 20 and 21 do not.

Positioned along the side of panel member 18 is a pivot column 26 which has a pivot bushing 35 connected thereto at its lower end by the screw 34. Pivot bushing 35 is adapted to be engaged by the projection 36 of the pivot block 38 which is attached to the expander jamb 29 also by the screws 34. It should be further noted that attached to the top of the expander jamb 29 is the same pivot block 38 for engagement with pivot bushing 35 which is secured to the bottom of the column 26. This will be more fully explained later in conjunction with FIGS. 12–23. Expander jamb 29 is in turn attached to a wall jamb 30 by the screws 34. Wall jamb 30 is secured to the wall such as 15 (see FIGS. 1 and 3).

As seen in FIG. 2, there are roller brackets 43 and 44 attached to the ends of top and bottom frames 20 and 21, respectively, of panel 17 by means of the screws 45. Rollers 46 are rotatably mounted on the brackets 43 by means of the arms such as 70 shown in FIG. 5 and ride in tracks 28 of panel 19. Suitable end caps 48 engage the roller brackets 43. Attached to the undersides of frames 21 and 24 are seals 57. Secured to the end of panel member 19 is a handle 59 enclosed at opposite ends by end caps 61 and retained by screws 34. Handle 59 has attached thereto a magnet 64.

As seen in FIG. 3, panel 19A also has a handle 59A attached to panel 19 which will also have a magnet such as 64 connected thereto. This construction affords a releasable but retentive closure of the bathing door units 10 and 10A as also seen in FIG. 3.

FIGS. 4–7 illustrate the roller bracket 43 and the positioning of the rollers 46 in the track 28 of the panel 19. Bracket member 43 has elongated arms 70 to which are attached the rollers 46 by means of the shafts 47 of screws 42 which are held in a nonrotatable manner by lock nuts 72 (See FIGS. 5, 7 and 9). The bracket member 43 is attached to the end of top frame 20 by the screws such as 45 passing through the slots 78 of the bracket member 43 and into grooves 79 of frame 20. This is best seen in FIG. 6. All of the frame extrusions have slots such as shown at 41 in FIG. 8 for receiving the panel members such as 16 and 18. The panel members have been secured therein by a suitable adhesive such as Speed Bonder 324 structural adhesive and solventless activator FMD 387 both available from the Loctite Corporation in Newington, Conn., or by suitable screw and hole connections.

Figure 5:
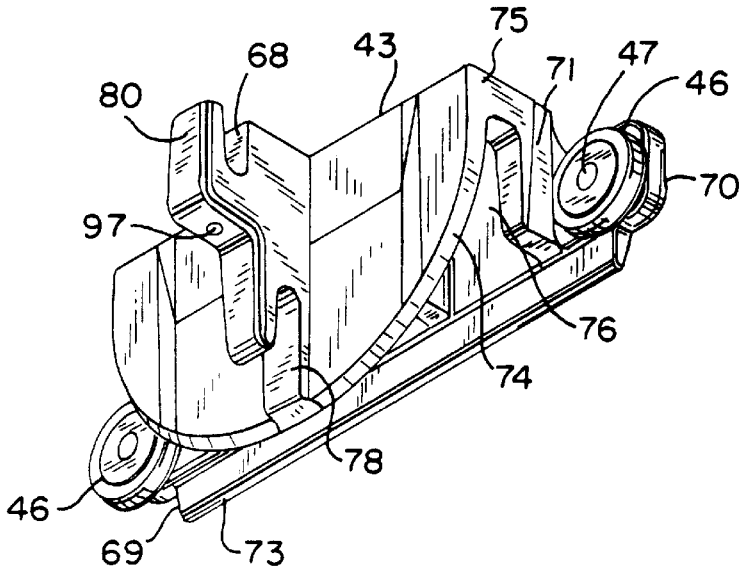
FIG. 5 is an enlarged detail view illustrating the slidable joint.

Referring specifically to FIGS. 4 and 5, there is illustrated the bracket arm 71 as well as a second arm 74 spaced from arm 71 and connected by bridge portion 75. This spacing provides a passage 76 for an upper portion of frame 23. Bracket 43 positions rollers 46 in the roller track 28 of top frame 20. Extending from arm 74 is flange 80 having the slots 68 and 78 for screws 45. It will be appreciated that the same positioning of the rollers 46 from the bracket 43 will prevail at the bottom ends of the panel 17 for positioning the rollers in the roller track 28 of frame 24 of panel 19, as seen in FIG. 2.

Figure 7:
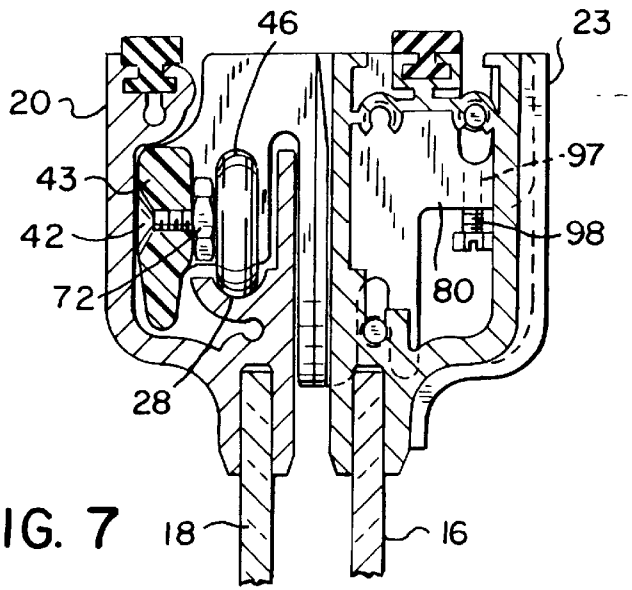
FIG. 7 is a sectional view taken along line 7—7 of FIG. 6.
Figure 11:
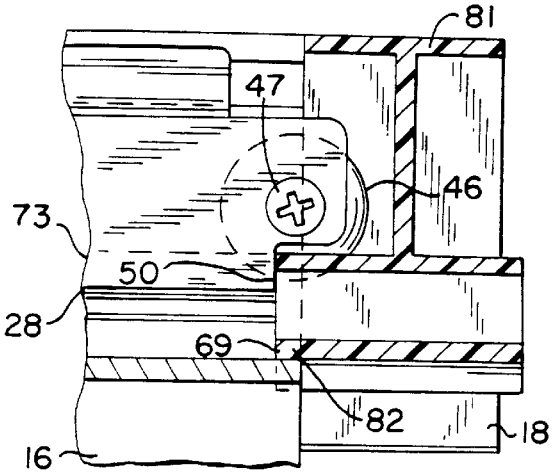
FIG. 11 is a sectional view taken along line 11—11 of FIG. 9.

FIGS. 4 and 7 illustrate the adjustment feature of upper roller bracket 43 and top frame 20 of panel 17. This is afforded by a threaded adjustment passage 97 extending through flange portion 80 of the bracket 43 with passage 97 accommodating screw 98. Adjustment of the position of bracket 43 and roller 46 against track 28 in frame 23 is effected by loosening screws 45 and 44 and turning adjustment screw 98 in threaded passage 97. When the desired adjustment is made, screws 45 and 44 are retightened.

As illustrated in FIGS. 8–11, there is a stop member 81 which is attached to top frame 23 of rolling panel 19 by the screw 45 and the slot 77 in frame 23. Stop member 81 has a protruding portion 82 which provides an extension of track 28, as well as a contact surface 50 for contact with an end surface 69 of bracket flange 73. This feature avoids contact with the roller 46 when rolling panel is in an extended position as seen in FIG. 3. It will also be appreciated that stop member 81 is also positioned at the bottom of panel 19 and is connected to bottom frame 24 for a similar purpose. End caps 48 are also attached to the stop member 81.

Referring to FIGS. 12–23 in conjunction with FIG. 2, these show the lifting mechanism for the panel 17 and accordingly panel 19. A pivot bushing 35 is attached to the pivot column 26 by screw 85 fastened to the underside of column 26, and a similar bushing 35 is connected to the top. Pivot bushings 35 engage pivot blocks 38. Pivot block 38 includes a connector section 83 and a camming section 84. Two stabilizing flanges 65 and 66 extend upwardly from a base 88 for engagement with expander jamb 29.

There are opposing hill type camming surfaces 86 and 87 disposed adjacent the bottom of camming section 84 for engagement with the hill type camming surfaces 89 and 90 extending downwardly from the camming section 91 of pivot bushing 35 with valley portions 99 and 100 therebetween. When the camming surfaces 90 and 91 rest between the camming surfaces 86 and 87, the panel members 17 and 19 will be in a lowered position as indicated in FIG. 20. When panel member 17 is pivoted, this will cause the camming surfaces 90 and 91 to ride up the camming surfaces 87 and 86 to ultimately rest thereon to effect a raising of the panel member 17 such as indicated in FIG. 21. This raising motion affords a distance between the panel members 17 and 19 and the upper edge of a bathing facility such as tub 13 to afford easy cleaning. A sufficient distance is provided between the similar camming surfaces of pivot bushing 35 and pivot block 38 at the top of wall jamb 30 to afford the lifting action. The pivoting action is guided by the annular wall 60 extending from camming section 84 and riding in annular groove 62 of camming section 91.

Figure 24:
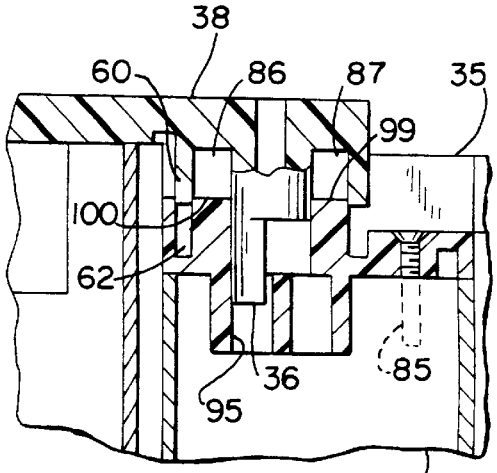
FIGS. 24 and 25 are sectional views illustrating the camming and retention feature at the top of a door unit
Figure 25:
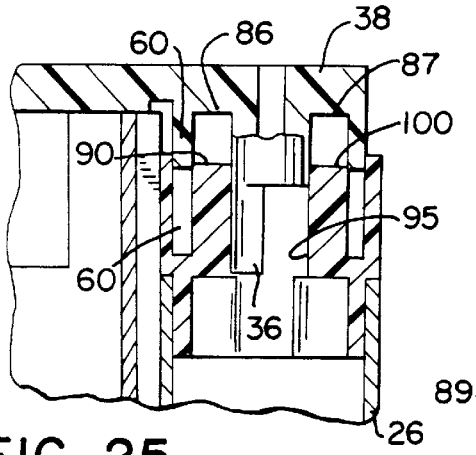
Figure 14:
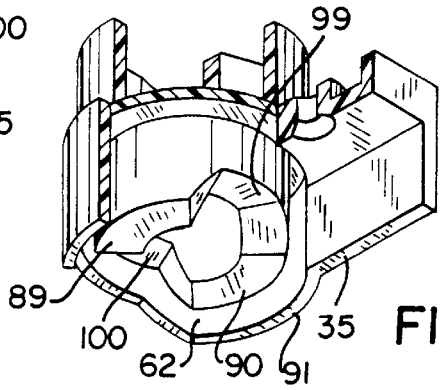
FIG. 14 is a bottom perspective view showing one of the camming members of the bistable mechanism.
Figure 15:
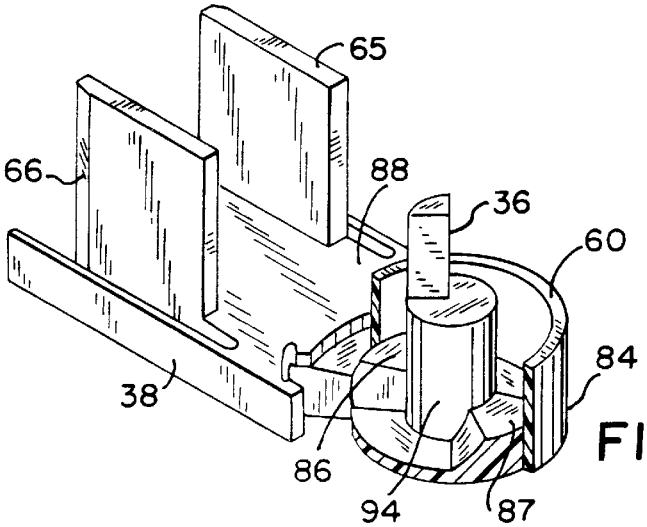
FIG. 15 is a top perspective view showing an opposing camming member.
Figure 12:
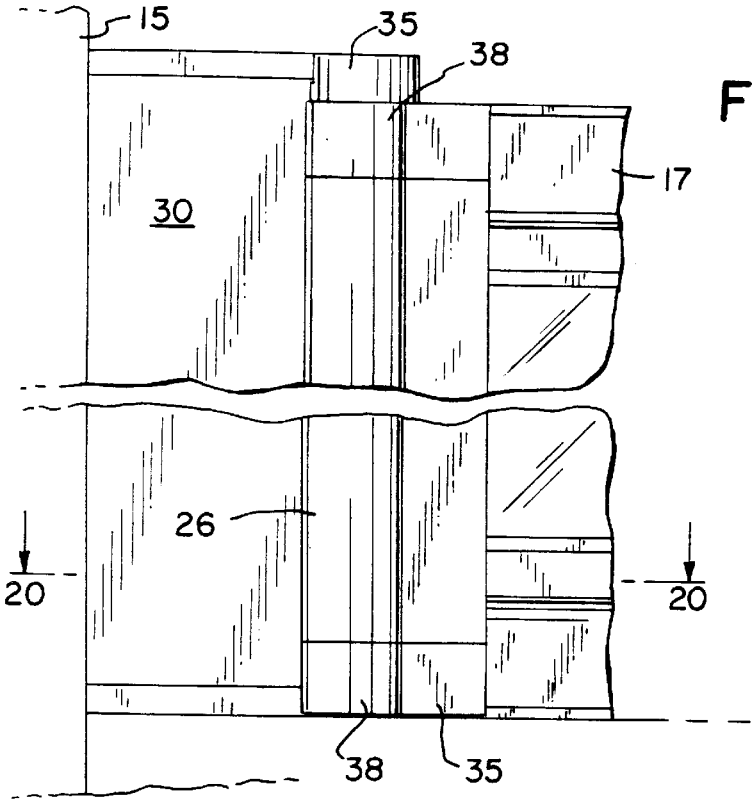
FIG. 12 is a partial side elevational view showing the attachment feature of the pivotal panel to the door.
Figure 13:
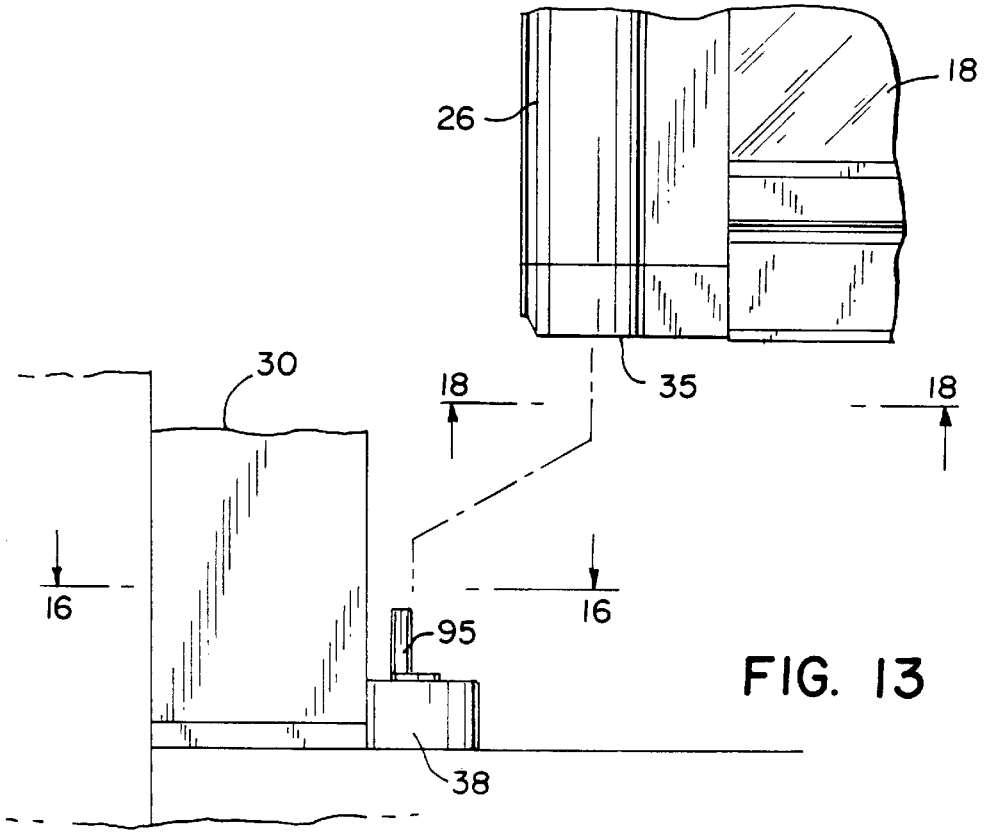
FIG. 13 is an exploded view illustrating a bistable positonary mechanism for the doors.

As seen in FIGS. 15 and 17, there is a post member 94 with an extending stop member 95 extending upwardly from camming section 84. This affords a stop for panel 17 when contact is made with stop member 96 of pivot bushing 35. This is illustrated in FIG. 21 when the panel 17 is in a raised position. It will be noted that the stop members 95 and 96 also engage when panel 17 is moved in a 180° position from that shown in FIG. 21. In order to prevent disengagement of the pivot bushing 31 and pivot block 33 at the top of panel 17 when panel 17 is in a lowered position and the valley portions 99 and 100 are positioned over camming surfaces 86 and 87, the stop member 36 extending from pivot block 38 will maintain contact with the inner annular surface 95 of pivot bushing 31. This is accomplished by having stop member 95 positioned adjacent expander jamb 29 in a 9 o'clock position and is illustrated in FIGS. 24 and 25.

An important feature in the fabrication of the bathing door unit 10 is the fact that there is no roller track in the pivotal panel nor rollers connected to the slidable or rolling panel for riding therein yet a stable door system results. This also affords ease and economy in fabrication.

It should be noted that the rolling panel members 16 and 16A are easily adjusted with respect to the pivotal panels 18 and 18A. This is accomplished by the adjustment screw 98 in conjunction with screws 45 and 48. It should be pointed out that once the bottom bracket 44 is connected to panel 17 only top bracket 43 need be adjusted.

Yet another unexpected feature is the simplified camming and stop feature as represented by stop members 95 and 96. This affords a positive stop in two directions. The use of the same camming members at the top and bottom of the door unit reduces costs of parts and assembly.

Still another important feature is the fact that a stable door system is afforded with only a discontinuous frame structure. As seen, panel members 16 and 18 are surrounded on three of their sides with frame structures such as top frame 20 and bottom frame 21 and pivot column 26 with respect to panel 16 and top and bottom frames 23 and 24 and handle 59 with respect to panel 18.

While preferred embodiments have been described above, it should be readily apparent to those skilled in the art from this disclosure that a number of modifications and changes may be made without departing from the spirit and scope of the invention. For example, in the previous description, there was shown two roller members 46 supported by single brackets 43 and 44. It can be appreciated that a multiplicity of roller members could be secured thereto. This would provide even a more stable and easily slidable bath door unit. However, it would be more costly. Further, while a magnetic attraction system is shown in FIGS. 2 and 3 for closing the opposing panels 19 and 19A of units 10 and 10A, the magnetic system could be employed in conjunction with one panel 19 of unit 10 and a magnetic strip such as fastened to a wall. Alternatively, these could be eliminated and still have the advantages of the simplified frame structure and roller system. The same is true with respect to the raising and lowering camming apparatus shown in FIGS. 12–22.

I claim:

1. A pivotal and extendable bathing door unit, comprising:

a first panel adapted to be pivotally connected to a supporting wall, said first panel having a roller bracket at the upper and lower ends thereof;

a second panel adapted to be extendably connected to said first panel, said second panel having a roller track at the upper and lower ends thereof; and first and second rollers connected to each said roller bracket in a spaced apart manner with said rollers of the upper bracket of the first panel being suitable to ride in the upper track of the second panel and the rollers of the lower bracket of the first panel being suitable to ride in the lower track of the second panel, said bathing door unit characterized by said second panel being devoid of any roller brackets or rollers.

2. The door unit as defined in claim 1, wherein at least one of said roller brackets includes an adjustment means for positioning said rollers relative to said tracks.

3. The door unit as defined in claim 1, further including roller stop members connected to the second panel for contacting one of the rollers to thereby limit extension of the second panel.

4. The door unit as defined in claim 1, wherein said first and second panels are secured to discontinuous frame structures.

5. The door unit as defined in claim 4, wherein said frame structures are of a three-sided configuration.

6. The door unit as defined in claim 1, further including camming means operatively associated with a lower end of a support for the first panel to provide a lifting action to said first panel assembly upon rotation thereof.

7. The door unit as defined in claim 6, wherein said camming means includes first and second camming members with interengaging stop surfaces to limit movement of said camming means.

8. The door unit as defined in claim 6, wherein a second camming means is operatively associated with an upper end of the support for the first panel to provide a guide therefor, said second camming means including first and second camming members with interengaging stop surfaces, said camming members being spaced from each other so as to prevent engagement during pivoting of the door unit.

9. A pivotal and extendable bathing door unit, comprising:

a first panel adapted to be pivotally connected to a supporting wall, said first panel having a roller bracket at the upper and lower ends thereof;

a second panel adapted to be extendably connected to said first panel, said second panel having a roller track at the upper and lower ends thereof;

first and second rollers connected to each said roller bracket in a spaced apart manner with said rollers of the upper bracket of the first panel being suitable to ride in the upper track of the second panel and the rollers of the lower bracket of the first panel being suitable to ride in the lower track of the second panel;

camming means operatively associated with a lower end of a support for the first panel to provide a lifting action to said first panel assembly up on rotation thereof, said camming means including first and second camming members with interengaging stop surfaces to limit movement of said camming means, said stop surfaces being defined by an extension of a post member connected to said first camming member and a projecting member connected to said second camming member.

10. A pivotal and extendable bathing door unit, comprising:

a first panel adapted to be pivotally connected to a supporting wall, said first panel having a roller bracket at the upper and lower ends thereof;

a second panel adapted to be extendably connected to said first panel, said second panel having a roller track at the upper and lower ends thereof;

first and second rollers connected to each said roller bracket in a spaced apart manner with said rollers of the upper bracket of the first panel being suitable to ride in the upper track of the second panel and the rollers of the lower bracket of the first panel being suitable to ride in the lower track of the second panel;

camming means operatively associated with a lower end of a support for the first panel to provide a lifting action to said first panel assembly upon rotation thereof;

second camming means operatively associated with an upper end of the support for the first panel to provide a guide therefor, said second camming means including first and second camming members with interengaging stop surfaces, said camming members being spaced from each other so as to prevent engagement during pivoting of the door unit, the stop surfaces being defined by an extension of a post member connected to one of the camming members and extending in contact with a surface of the other of the camming members.

* * * * *